US011382814B2

(12) United States Patent
Chang

(10) Patent No.: US 11,382,814 B2
(45) Date of Patent: Jul. 12, 2022

(54) HANGING KIT

(71) Applicant: Hsiao-Wen Chang, Lighthouse Point, FL (US)

(72) Inventor: Hsiao-Wen Chang, Lighthouse Point, FL (US)

( * ) Notice: Subject to any disclaimer, the term of this patent is extended or adjusted under 35 U.S.C. 154(b) by 0 days.

(21) Appl. No.: 17/084,682

(22) Filed: Oct. 30, 2020

(65) Prior Publication Data

US 2022/0133564 A1 May 5, 2022

(51) Int. Cl.
*A61G 7/075* (2006.01)
*A61G 7/10* (2006.01)

(52) U.S. Cl.
CPC ..... *A61G 7/075* (2013.01); *A61G 7/1023* (2013.01); *A61G 7/1051* (2013.01); *A61G 7/1013* (2013.01); *A61G 7/1049* (2013.01)

(58) Field of Classification Search
CPC ..... A61G 7/065; A61G 7/075; A61G 7/0755; A61G 7/1013; A61G 7/1023; A61G 7/1049; A61G 7/1051; A61G 7/1082; A61G 7/1092; A61G 7/1096
USPC ..... 5/621, 623, 624, 646–648, 650, 89.1, 5/81.1 R
See application file for complete search history.

(56) References Cited

U.S. PATENT DOCUMENTS 4,903,355 A * 2/1990 Hickerson ..... A61G 7/10 5/83.1
4,979,520 A * 12/1990 Boone, Jr. ..... A61G 1/01 128/870
5,647,378 A * 7/1997 Farnum ..... A61F 5/03 128/876
5,815,859 A * 10/1998 Lavin ..... A61G 7/1046 5/89.1
6,073,280 A * 6/2000 Farnum ..... A61F 5/03 128/876
6,581,222 B1 * 6/2003 Liljedahl ..... A61G 7/1017 5/89.1
6,908,131 B2 * 6/2005 Main ..... A61G 7/1023 294/150
7,351,216 B2 * 4/2008 Walsh ..... A61F 5/3769 128/845
8,566,977 B2 * 10/2013 Davis ..... A61G 7/1025 5/81.1 HS
8,661,580 B2 * 3/2014 Giap ..... A61G 7/1051 5/88.1
9,693,919 B2 * 7/2017 Berman ..... A61G 7/1023
10,039,680 B2 * 8/2018 Galbraith ..... A61G 7/1073
10,117,800 B1 * 11/2018 Galbraith ..... A61G 7/1051
10,561,522 B2 * 2/2020 Giap ..... A61G 7/1063
10,772,778 B2 * 9/2020 Hahn ..... A61G 7/05715
11,077,004 B2 * 8/2021 Arnold ..... A41D 1/00
(Continued)

FOREIGN PATENT DOCUMENTS

EP 3943056 A1 * 1/2022 ..... A61F 13/42

*Primary Examiner* — Robert G Santos
(74) *Attorney, Agent, or Firm* — WPAT, PC

(57) ABSTRACT

A hanging kit includes a supporting member having at least one fixing portion and two suspending members respectively located at two opposite sides of the supporting member. The fixing portion has two coupling portions configured for coupling with each other. Each of the two suspending members has at least one suspending part and a connecting part, and the connecting part is configured for respectively connecting the two suspending members to the supporting member.

5 Claims, 6 Drawing Sheets

(56) References Cited

U.S. PATENT DOCUMENTS

| | | | | |
|---|---|---|---|---|
| 2004/0004367 | A1* | 1/2004 | Main | A61G 7/1023 294/150 |
| 2005/0204470 | A1* | 9/2005 | Main | B66C 1/18 5/81.1 T |
| 2006/0167397 | A1* | 7/2006 | Walsh | A61F 5/3769 602/32 |
| 2008/0209630 | A1* | 9/2008 | Kazala | A61G 7/1026 5/81.1 T |
| 2011/0289688 | A1* | 12/2011 | Lewis | A61F 5/028 5/650 |
| 2011/0296609 | A1* | 12/2011 | Giap | A61G 7/1092 5/88.1 |
| 2012/0210511 | A1* | 8/2012 | Davis | A61G 7/1025 5/81.1 R |
| 2013/0116604 | A1* | 5/2013 | Morilla | A61G 7/1015 601/33 |
| 2013/0152950 | A1* | 6/2013 | Giap | A61G 7/1023 128/872 |
| 2014/0041114 | A1* | 2/2014 | Davis | A61G 7/1051 5/83.1 |
| 2016/0095777 | A1* | 4/2016 | Berman | A61G 7/1023 5/81.1 T |
| 2016/0374883 | A1* | 12/2016 | Galbraith | A61G 7/1051 5/81.1 T |
| 2017/0112655 | A1* | 4/2017 | Giap | A61F 5/3761 |
| 2018/0303690 | A1* | 10/2018 | Hahn | A61G 7/1055 |
| 2018/0318162 | A1* | 11/2018 | Galbraith | A61G 7/1055 |
| 2020/0046588 | A1* | 2/2020 | Arnold | A61G 7/1023 |
| 2022/0015972 | A1* | 1/2022 | Conejo Castano | A61G 7/1015 |
| 2022/0133564 | A1* | 5/2022 | Chang | A61G 7/1023 5/630 |

* cited by examiner

HANGING KIT

BACKGROUND OF THE INVENTION

1. Field of the Invention

The present invention relates to a fixing equipment and, more particularly, to a hanging kit for suspending and fixing a limb.

2. Description of the Related Art

Generally, while caring a patient, the patient needs to be moved frequently, such as for posture changing, cleaning, cloth changing, etc. However, such movements of the patient will cause a burden to a person caring the patient. Thus, a displacing machine is frequently used to move the patient. The conventional displacing machine has a suspending arm, and a conventional hanging kit can be hanged to the suspending arm after circling a limb of the patient. Thus, the limb of the patient can be hanged on the suspending arm for caring. Nonetheless, the conventional hanging kit can only hold the limb of the patient, resulting in the limb of the patient being prone to drop from the conventional hanging kit during movement of the suspending arm.

In light of this, it is necessary to improve the conventional hanging kit.

SUMMARY OF THE INVENTION

To solve the above disadvantages, it is an objective of the present invention to provide a hanging kit capable of effectively improving a fastness of the hanging kit holding a limb of a patient, preventing the limb of the patient from dropping from the hanging kit hanged on a supporting arm of a displacing machine.

It is another objective of the present invention to provide a hanging kit capable of further improving a safety when moving the limb of the patient.

As used herein, the term "one", "a" or "an" for describing the number of the elements and members of the present invention is used for convenience, provides the general meaning of the scope of the present invention, and should be interpreted to include one or at least one. Furthermore, unless explicitly indicated otherwise, the concept of a single component also includes the case of plural components.

As used herein, the term "couple", "assembly", or similar terms is used to include separation of connected members without destroying the members after connection or inseparable connection of the members after connection. A person having ordinary skill in the art would be able to select according to desired demands in the material or assembly of the members to be connected.

A hanging kit according to the present invention includes a supporting member having at least one fixing portion and two suspending members respectively located at two opposite sides of the supporting member. The fixing portion has two coupling portions configured for coupling with each other. Each of the two suspending members has at least one suspending part and a connecting part, and the connecting part is configured for respectively connecting the two suspending members to the supporting member. The hanging kit further includes a fastening portion adjacent to an end of one of the two suspending members connected to the supporting member, and the fastening portion is configured to position the other one of the two suspending members. A through hole can be formed between the fastening portion and the supporting member. Thus, in a hanging state, the other one of the two suspending members passes through the through hole.

Accordingly, the hanging kit of the present invention can stably fix the limb of the patient on the supporting member with the fixing member, so that the limb of the patient will not drop from the supporting member when the limb of the patient is moved. Thus, the limb of patient can be securely fixed for convenient caring of the patient, such as cleaning, cloth changing, etc. Furthermore, one of the suspending members can be positioned by the fastening portion to prevent the two suspending members from separating from each other when hanging and hence to improve a fastness of the supporting member holding the limb of the patient. Thus, the limb of the patient will not drop from the supporting member to avoid injury of the patient.

In an example, the fixing portion is coupled with a surface of the supporting member by a connecting part located between two ends of the fixing portion. The two coupling portions are respectively located at two opposite sides of the supporting member with respect to the connecting part. Thus, the fixing portion can surround on a circumference of the limb of the patient, and the limb of the patient can be fixed by the two ends overlapping with each other to improve a fixing stability of the hanging kit.

In an example, the two coupling portions are configured to be a hook-and-loop fastener. Thus, the tightness of the fixing portion surrounding the limb of the patient can be conveniently adjusted to improve a convenience of using the hanging kit.

In an example, the two opposite sides of the supporting member are configured for detachably coupling with each other by a plurality of positioning members. Thus, the stability of the supporting member holding the limb of the patient can be improved.

In an example, each of the two suspending members has a plurality of suspending parts arranged at intervals. Thus, the two suspending members can be hanged with the suspending parts at different position, enabling adjustment of a hanging height of the limb of the patient.

BRIEF DESCRIPTION OF THE DRAWINGS

The present invention will become clearer in light of the following detailed description of illustrative embodiments of this invention described in connection with the drawings.

Figure 1:
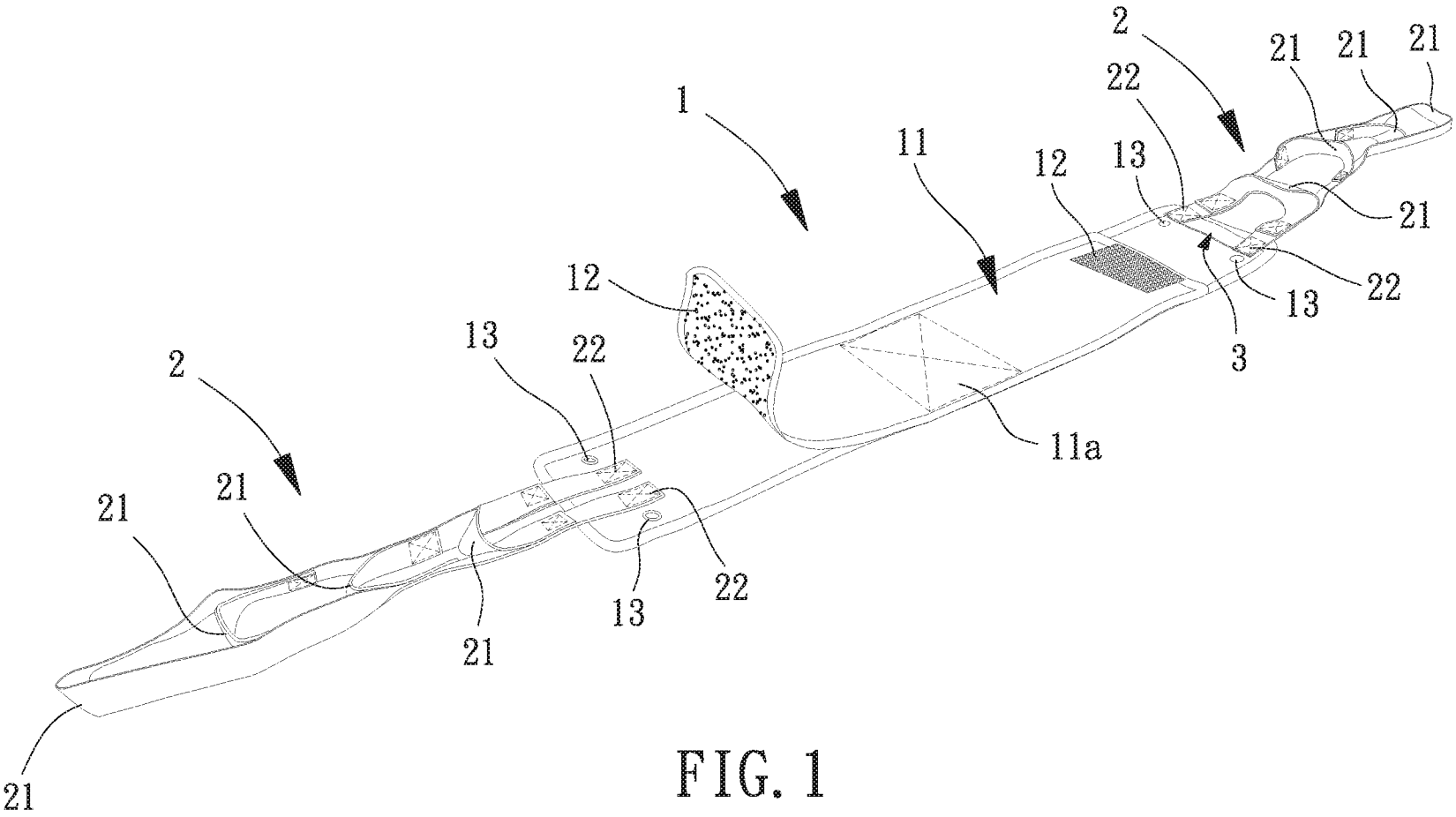
FIG. 1 is a perspective view of an embodiment of the present invention.

When the terms "front", "rear", "left", "right", "up", "down", "top", "bottom", "inner", "outer", "side", and similar terms are used herein, it should be understood that these terms have reference only to the structure shown in the drawings as it would appear to a person viewing the drawings and are utilized only to facilitate describing the invention, rather than restricting the invention.

DETAILED DESCRIPTION OF THE INVENTION

Figure 2:
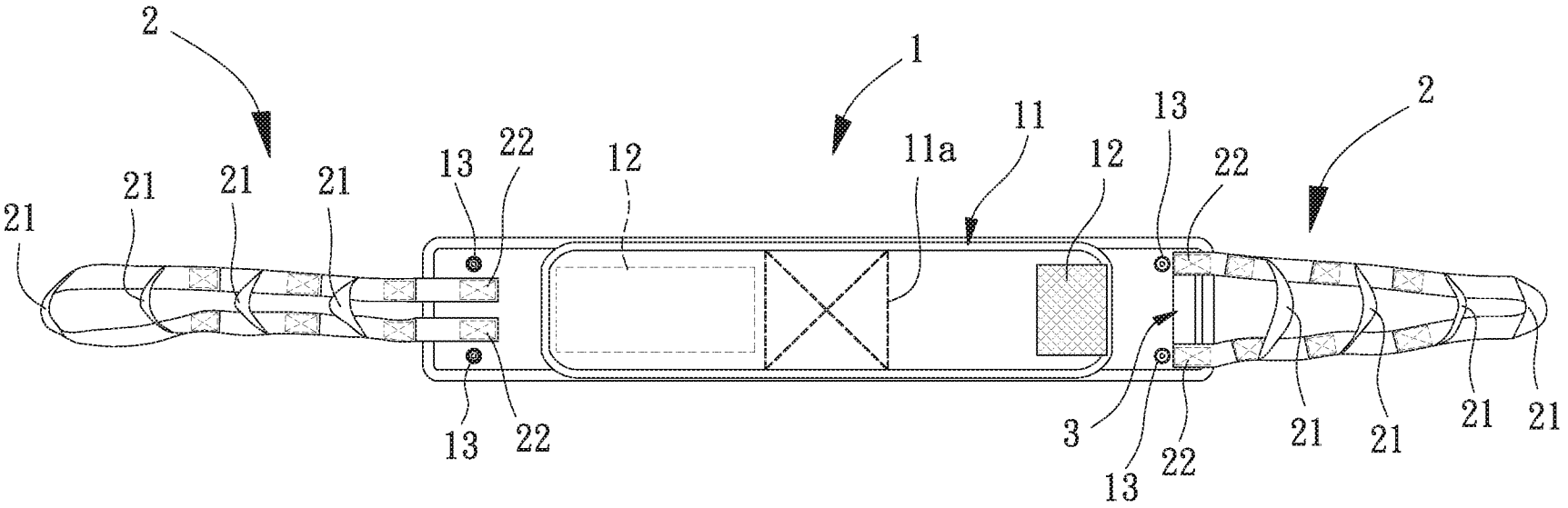
FIG. 2 is a top view of an embodiment of the present invention.

Referring to FIGS. 1 and 2, which show an embodiment of a hanging kit of present invention. The hanging kit includes a supporting member 1 and two suspending members 2, the two suspending members 2 are respectively located at two opposite sides of the supporting member 1.

Figure 3:
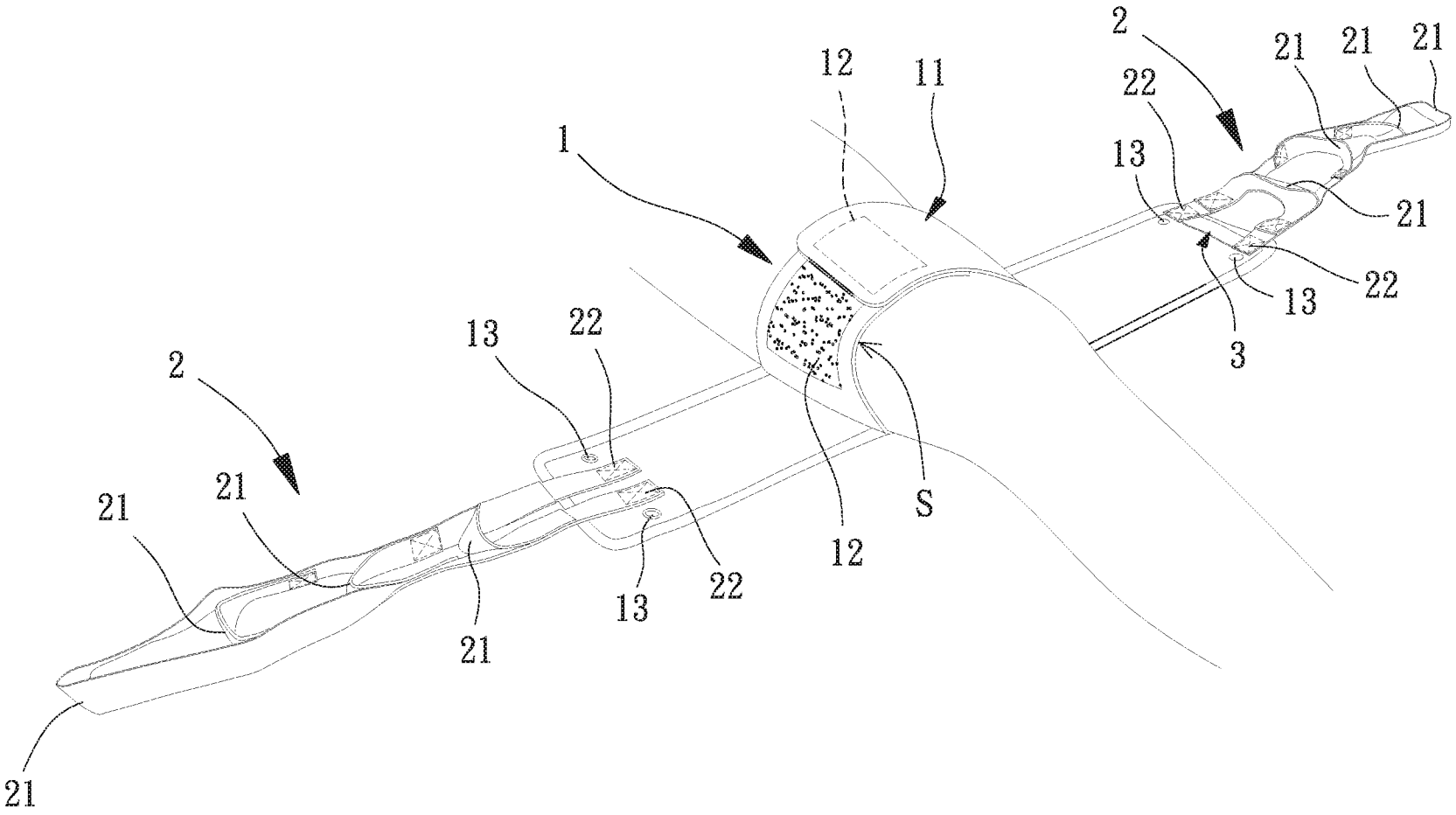
FIG. 3 shows a limb of the patient fixed by the hanging kit of an embodiment of the present invention.

As shown in FIGS. 1 and 3, the supporting member 1 can surround a limb of a patient who needs to be suspended, so that when the hanging kit is hanged on a displacing machine, the supporting member 1 can hold the limb of the patient and the limb placed between two side of the supporting member 1. The supporting member 1 has at least one fixing portion 11 that can fix the limb of the patient to prevent avoid dropping from the supporting member 1. The fixing portion 11 can couple with a surface of the supporting member 1 by means of glue bonding, seaming, etc. When the supporting member 1 holds the limb of the patient, the limb can conveniently be fixed by the fixing portion 11. The fixing portion 11 can be a rope or a band. In this embodiment, the fixing portion 11 is a band. The fixing portion 11 has a connecting part 11*a*, the fixing portion 11 can be coupled with a surface of the supporting member 1 by the connecting part 11*a*. The fixing portion 11 has two coupling portions 12 that can be coupled with each other. The two coupling portions 12 can be detachably coupled with each other by means of a buckle, a tie, a hook-and-loop fastening configuration (such as the one sold under the Trademark of "Velcro"), etc., so that the fixing portion 11 can circle to form a fixing space S. The two coupling portions 12 can be respectively located at the two opposite sides of the connecting part 11*a*. Therefore, the fixing portion 11 can surround on a circumference of the limb of the patient, and be coupled to fix the limb of the patient. When the two coupling portions 12 are Velcro, the limb of the patient can be tightly fixed by adjusting an overlapping area of the two coupling portions 12.

Figure 6:
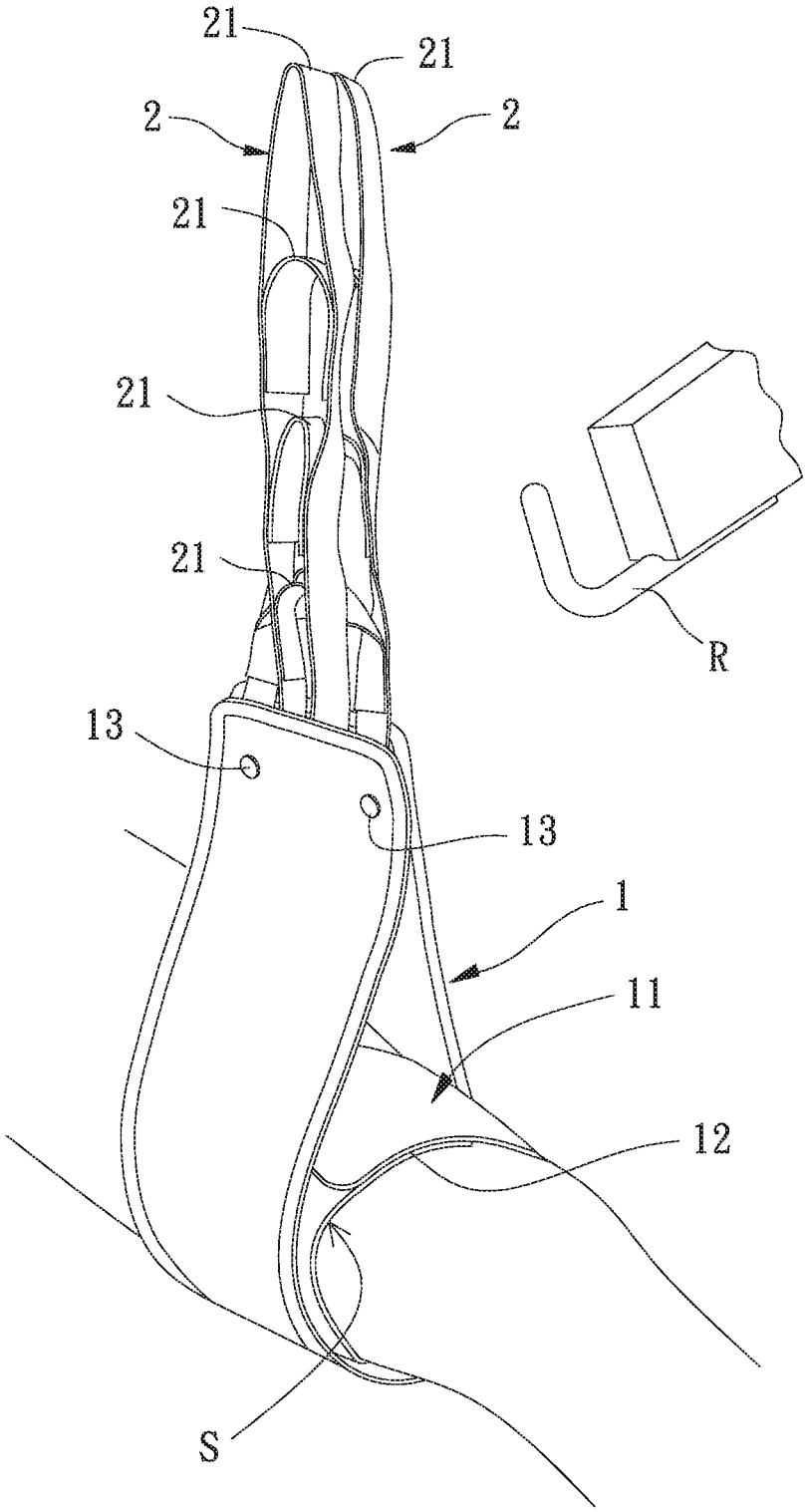
FIG. 6 shows a limb of the patient surrounded by the supporting member of an embodiment of the present invention.

As shown in FIGS. 1 and 6, the two suspending members 2 are respectively located on the two opposite sides of the supporting member 1. The supporting member 1 is hanged by the two suspending members 2 while hanging the hanging kit on the displacing machine. Preferably, the two suspending members 2 are respectively located at the same distance on the two opposite sides of the supporting member 1 to approximately align the two opposite sides of the supporting member 1. The two suspending members 2 can be ropes, bands, rings or hooks, etc., while the present invention is not limited in this regard. In this embodiment, the two suspending members 2 can be bands, and each of the two suspending members 2 has a suspending part 21 and a connecting part 22. Each of the two suspending members 2 is connected with the supporting member 1 by the connecting part 22. The suspending part 21 is configured for hanging on a suspending arm R of the displacing machine. Preferably, each of the two suspending members 2 has a plurality of suspending parts 21 arranged at intervals. Therefore, the suspending member 2 can adjust a suspending height of the limb of the patient with the plurality of suspending parts 21 in different position.

Figure 4:
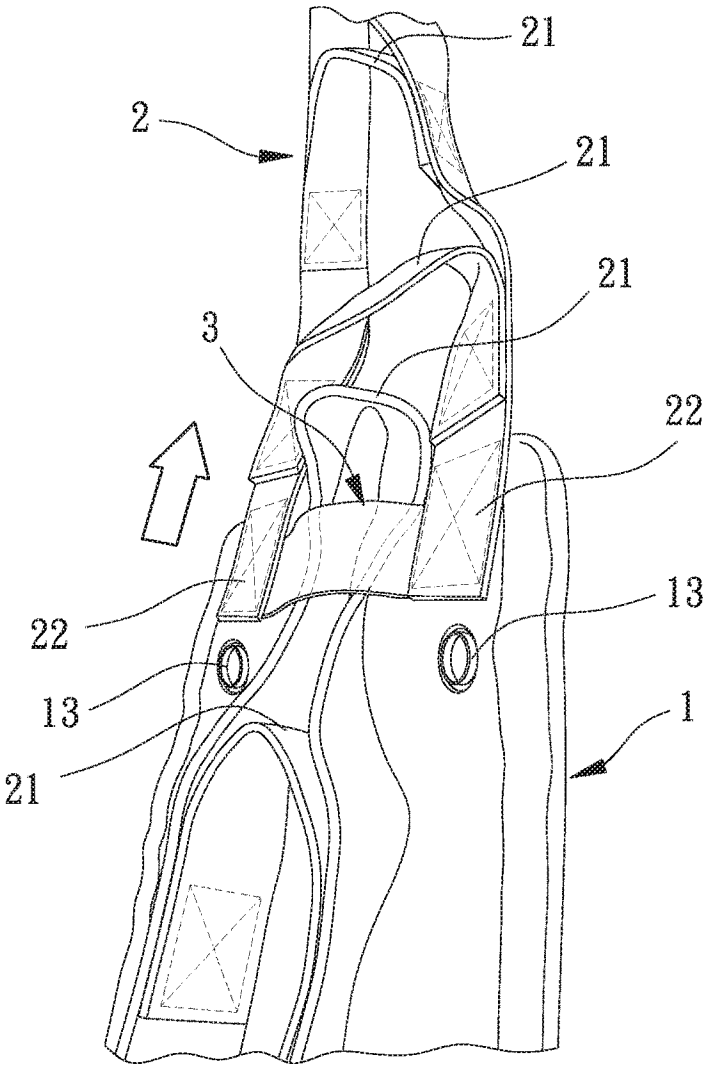
FIG. 4 shows one of the suspending members passing through a hole between a fastening portion and a supporting member.

Referring to FIGS. 1 and 4, the supporting member 1 further has a plurality of positioning members 13 respectively located at the two opposite sides of the connecting part 11*a*. The plurality of positioning members 13 can be in button forms respectively matched with the corresponding one on the opposite side of the connecting part 11*a* for detachably coupling. Therefore, the two opposite sides of the supporting member 1 can be coupled by matching the plurality of positioning members 13 when the two suspending members 2 are lifted and approached to each other. Thus, the fastness of the supporting member 1 when holding the limb of the patient is further improved.

Figure 5:
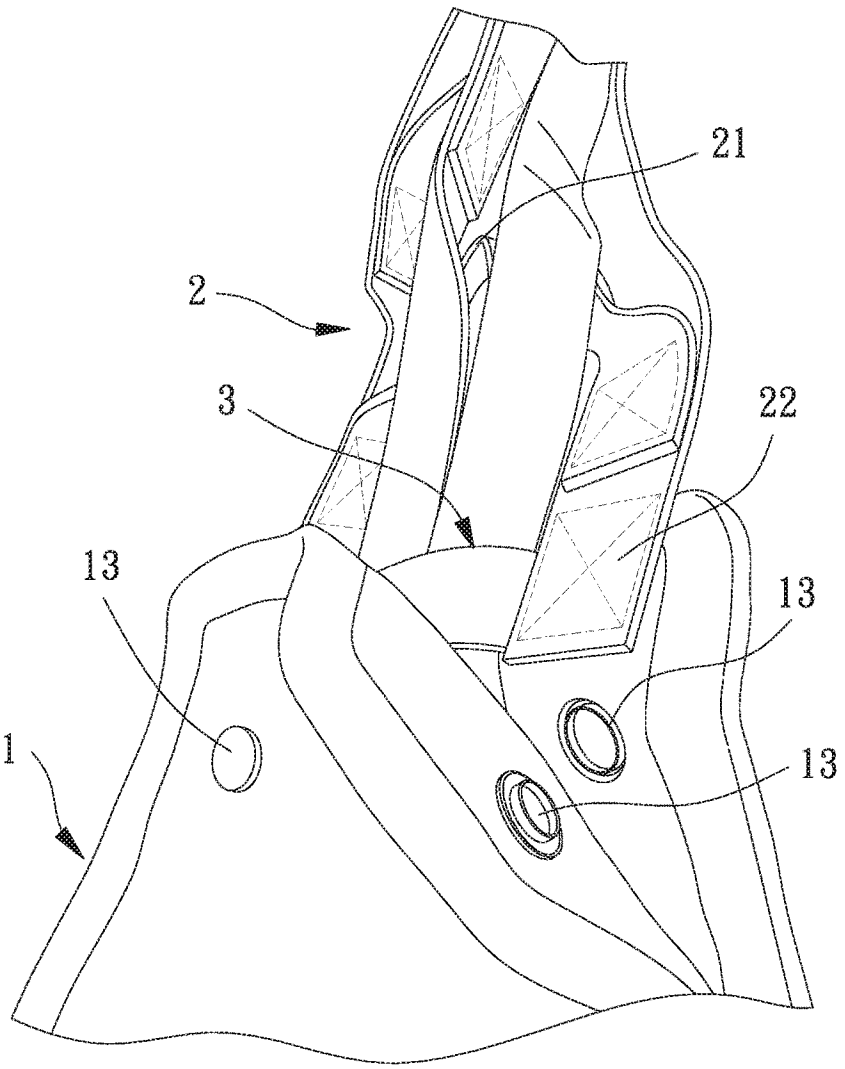
FIG. 5 shows each of two opposite sides of the supporting member coupled with each other.

Referring to FIGS. 4 and 5, preferably, the hanging kit of the present invention further has a fastening portion 3 which is adjacent to an end of the suspending member 2 connected to the supporting member 1. The fastening portion 3 can be disposed on the supporting member 1 or the two suspending members 2. In this embodiment, the fastening portion 3 is disposed at the end of the supporting member 1. A through hole can be formed between the fastening portion 3 and the supporting member 1 by seaming the fastening portion 3 on the supporting member 1, such that the other suspending member 2 can pass through the through hole between the fastening portion 3 and the supporting member 1, and be hanged on the displacing machine. Therefore, it can be assured that the other ends away from the end adjacent to the fastening portion 3 of the two suspending members 2 will not separate from each other, thereby improving the fastness of supporting member 1 holding the limb of the patient.

Figure 7:
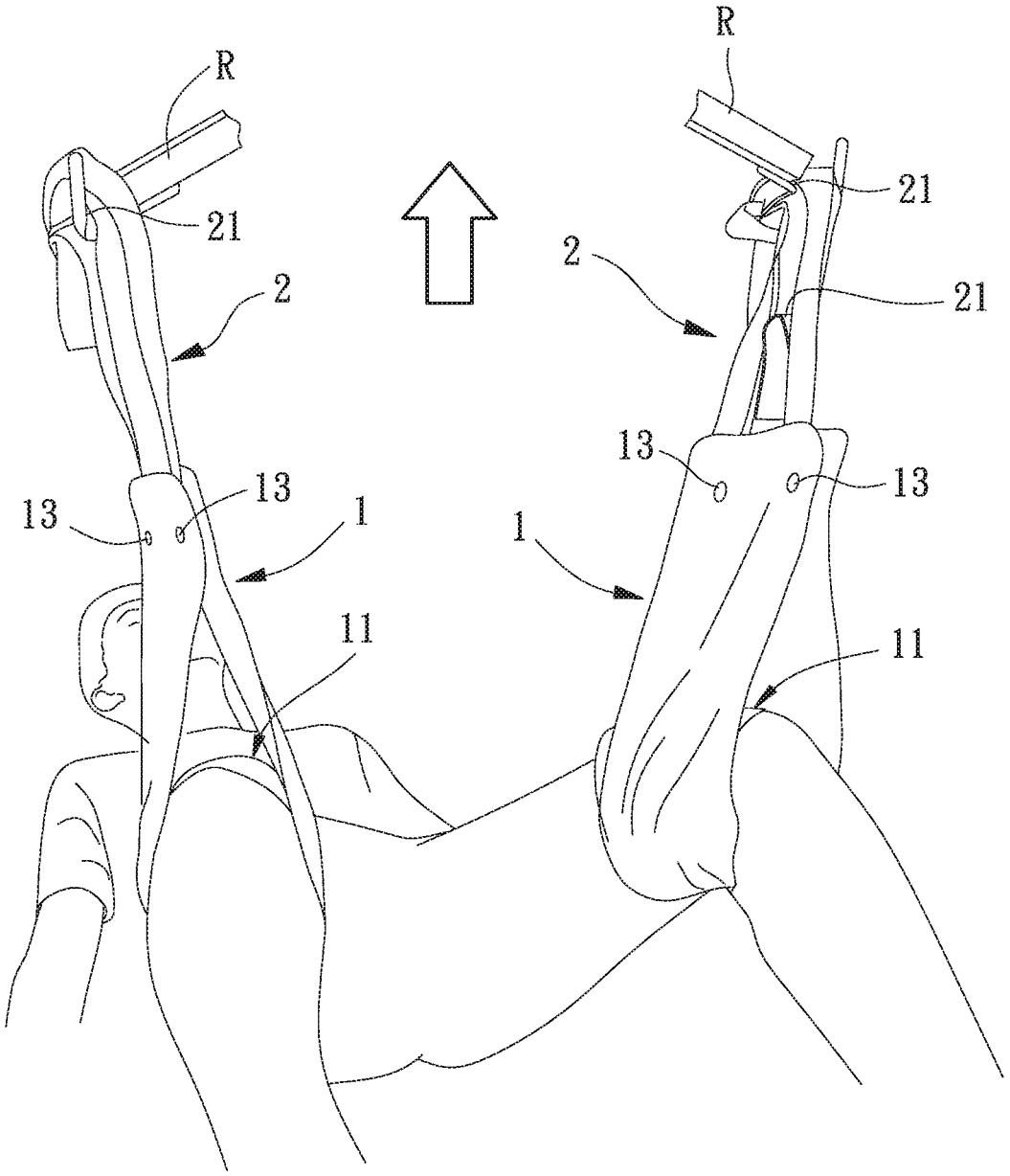
FIG. 7 shows a limb of the patient lifted by the hanging kit of an embodiment of the present invention.

Referring to FIGS. 6 and 7, when the limb of the patient on the bed needs to be moved, the supporting member 1 could be placed under the limb and secure the limb in the fixing space S with the fixing portion 11, such that the limb can be securely fixed between the two opposite sides of the supporting member 1. The suspending arms R are respectively connected to the suspending parts 21 of the suspending members 2 to lift the two opposite sides of the supporting member 1, so that the supporting member 1 surrounds the limb of the patient to move the limb of the patient for convenient caring of the patient, such as cleaning, cloth changing, etc.

In summary, the hanging kit of the present invention can stably fix the limb of the patient in the supporting member with the fixing member, so that the limb of the patient will not drop from the supporting member when the limb of the patient is moved. Thus, the limb of patient can be securely fixed for convenient caring of the patient, such as cleaning, cloth changing, etc. Furthermore, one of the suspending members can be positioned by the fastening portion to prevent the two suspending members from separating from each other when hanging. Thus, the limb of the patient will not drop from the supporting member to avoid injury of the patient.

Although the invention has been described in detail with reference to its presently preferable embodiments, it will be understood by one of ordinary skill in the art that various modifications can be made without departing from the spirit and the scope of the invention, as set forth in the appended claims.

What is claimed is:

1. A hanging kit comprising:

a supporting member having at least one fixing portion, wherein the at least one fixing portion has two coupling portions configured for coupling with each other;

two suspending members respectively located at two opposite sides of the supporting member, wherein each of the two suspending members has at least one suspending part and a connecting part, and wherein the connecting part is configured for respectively connecting the two suspending members to the supporting member; and a fastening portion adjacent to an end of one of the two suspending members connected to the supporting member, and the fastening portion is configured to position the other one of the two suspending members;

wherein a through hole is formed between the fastening portion and the supporting member; and wherein in a hanging state, the other one of the two suspending members passes through the through hole.

2. The hanging kit as claimed in claim 1, wherein the at least one fixing portion is coupled with a surface of the supporting member by a connecting part located between two ends of the at least one fixing portion, and wherein the two coupling portions are respectively located at two opposite sides of the supporting member with respect to the connecting part.

3. The hanging kit as claimed in claim 1, wherein the two coupling portions are configured to be a hook-and-loop fastener.

4. The hanging kit as claimed in claim 1, wherein the two opposite sides of the supporting member are configured for detachable coupling with each other by a plurality of positioning members.

5. The hanging kit as claimed in claim 1, wherein each of the two suspending members has a plurality of suspending parts arranged at intervals.

* * * * *